US007218870B2

(12) United States Patent
Hirobe

(10) Patent No.: US 7,218,870 B2
(45) Date of Patent: May 15, 2007

(54) IMAGE FORMING APPARATUS

(75) Inventor: Fumitake Hirobe, Ushiku (JP)

(73) Assignee: Canon Kabushiki Kaisha, Tokyo (JP)

( * ) Notice: Subject to any disclaimer, the term of this patent is extended or adjusted under 35 U.S.C. 154(b) by 101 days.

(21) Appl. No.: 11/076,925

(22) Filed: Mar. 11, 2005

(65) Prior Publication Data

US 2005/0213999 A1 Sep. 29, 2005

(30) Foreign Application Priority Data

Mar. 23, 2004 (JP) ..... 2004-085692

(51) Int. Cl.
*G03G 15/08* (2006.01)
*G03G 15/00* (2006.01)
*G03G 15/10* (2006.01)

(52) U.S. Cl. ..... 399/27; 399/44; 399/49; 399/60; 399/62

(58) Field of Classification Search ..... 399/27, 399/29, 44, 49, 60, 61, 62, 63
See application file for complete search history.

(56) References Cited

U.S. PATENT DOCUMENTS

| | | | | |
|---|---|---|---|---|
| 5,819,132 | A | 10/1998 | Hirobe | 394/49 |
| 6,442,355 | B2 | 8/2002 | Hasegawa et al. | 399/58 |
| 6,702,060 | B2 | 3/2004 | Tatewaki et al. | 180/444 |
| 6,856,773 | B2 * | 2/2005 | Hirobe et al. | 399/49 |
| 6,938,723 | B2 | 9/2005 | Tatewaki et al. | 180/444 |
| 6,947,681 | B2 * | 9/2005 | Ogata | 399/58 |
| 2001/0055497 | A1 | 12/2001 | Hasegawa et al. | 399/58 |
| 2004/0076451 | A1 | 4/2004 | Hirobe | 399/252 |
| 2004/0205342 | A1 | 10/2004 | Roegner | 713/168 |
| 2005/0205342 | A1 | 9/2005 | Tatewaki et al. | 180/444 |
| 2005/0213999 | A1 | 9/2005 | Hirobe | 399/27 |

FOREIGN PATENT DOCUMENTS

| | | |
|---|---|---|
| EP | 1 403 598 A | 3/2004 |
| JP | 63-177177 | 7/1988 |
| JP | 10-083115 | 3/1998 |
| JP | 2001-194837 | 7/2001 |
| JP | 2002-006684 | 1/2002 |

* cited by examiner

*Primary Examiner*—Hoang Ngo
(74) *Attorney, Agent, or Firm*—Fitzpatrick, Cella, Harper & Scinto

(57) ABSTRACT

An image forming apparatus includes an image forming portion, a developing apparatus, a developer density detection portion, an image density detection portion, an environment detection portion, and a developer replenishing apparatus. The image forming apparatus further includes a control portion for performing a replenishing operation of the developer replenishing apparatus. The control portion also performs an image density control for controlling an electrostatic image forming condition of the image forming portion. When a detection result by the environment detection portion is changed by a predetermined value or the replenishment developer is renewed, the image forming apparatus advances to a mode of performing the image density control, while performing the replenishing operation by developer replenishing apparatus based on the detection result of the developer density detecting portion.

8 Claims, 7 Drawing Sheets

IMAGE FORMING APPARATUS

BACKGROUND OF THE INVENTION

1. Field of the Invention

The present invention relates to an image forming apparatus such as a copying machine and a laser beam printer, and more particularly, to an image forming apparatus using a two-component developer.

2. Related Background Art

Heretofore, in general, in an image forming apparatus of an electrophotographic or an electrostatic recording system such as a copying machine which uses a two-component developer mainly composed of a toner and a carrier, when the toner is consumed and a developer density inside an developing apparatus, that is, a mixture ratio of the toner to the carrier (hereinafter referred to as "TD ratio") changes, so that an image of a low image ratio is continuously reproduced, the imbedding of an external additive externally added for giving fluidity to the toner as well as adherence of the toner and the external additive to the carrier surface have often changed developing property and transferring property, thereby remarkably deteriorating these properties.

Hence, to maintain the TD ratio which is a toner density in the developer and the density of a formed image constant, a technique for accurately detecting this TD and the image density becomes important.

The image forming apparatus adapting the two-component developer system is provided with a replenishment developer container (replenishment container) connected to a developer container for replenishing a consumed toner included in the developer inside the developer container which is a developer containing portion of a developing apparatus. The replenishment developer container contains a replenishment toner as a developer cartridge, and is usually detachably attachable so as to be replaced when an inner toner is consumed. A toner replenishing control is proposed and put to a practical use, which decides a toner amount to be replenished to the developing apparatus by the replenishment container so that a detection value by an image density detection and the TD ratio detection of the developer inside the developer container (hereinafter referred to as "developer density detection") is always maintained constant.

In other words, according to the above described toner replenishing control, a lowering of toner charge amount over a long period of time during image formation is avoided by adequately lowering the toner density of the two component developer of the developing container, and the image density during image formation is maintained constant over a long period of time.

The toner replenishing control is executed at a pre-rotation time which is a non image time of the image formation, and when an image density lowering is detected by image density detecting means (image density sensor) in an density detection developed image (patch), the toner of the developer inside the developing apparatus is replenished. In case a replenishing amount from the replenishment container to the developing apparatus based on this image density detection result becomes excessive, a signal of the replenishing amount to be excessive is sent out by developer density detection inside the developing apparatus, and a control of replenishing amount as well as a control of stopping the replenishment are performed.

In general, the developer density detection is performed by developer density detecting means such as a light sensor or a magnetic permeability detection sensor and the like provided in the developing apparatus where the developer is contained. In the case of the light sensor, by irradiating a light, the carrier is attracted because of its ordinary black color, and the TD ratio is discriminated by detecting a change in the toner amount, that is, the reflected light amount corresponding to the TD ratio. The magnetic permeability detection sensor discriminates the TD ratio by detecting an apparent magnetic permeability change in the developer, which lowers when the TD ratio rises.

In the meantime, the detection of the image density which is a toner bearing amount in the image portion of an image to be formed, in the case of the image forming apparatus of the electrophotographic system already charged, forms a density detection electrostatic latent image (patch latent image) by a predetermined latent image contrast on an image bearing member such as a drum-shaped electrophotographic photosensitive member (photosensitive drum), and develops this patch latent image by the two-component developer contained in the developing apparatus, and takes it as the density detection developed image (patch). On this patch image, a light is irradiated by the light sensor as the image density sensor, and the detection is performed depending on various magnitudes of the reflected light.

While the electrostatic latent image is formed by changing a surface potential in the image portion of the uniformly charged image bearing member, the difference of the surface potential between the non-image portion and the image portion is the latent image contrast. In the image forming apparatus of the electrophotographic system, since the image bearing member is a photosensitive drum, in the toner replenishing control, the charged potential and the exposed light amount are adjusted so as to become a predetermined latent image contrast on this photosensitive drum, thereby forming a patch latent image.

Incidentally, at the installing time of the image forming apparatus and at the replacing time of the developer, though a new developer is filled in the developing apparatus, the developer right after being transferred to the developing apparatus inside the image forming apparatus from a container to be used and hermetically sealed at the time of shipment is in a state of being moisture conditioned to a moisture amount inside the container before the transfer, and the developer is gradually exposed to the outside air inside the developing apparatus, and is moisture conditioned to the moisture amount detected by environmental detecting means (environmental sensor) provided inside the image forming apparatus. During this moisture conditioning, a tribo-electrostatic charge (tribo) in the developer also is changed from a value inside the replenishment container to a value corresponding to the moisture amount detected by the environmental sensor.

Here, to correspond to the change of endurance and environment, a patch is periodically formed by a predetermined density, and by detecting an output value of the image density, a density signal from the apparatus control portion is corrected, and based on that information, the latent image contrast, which is a latent image forming condition to form a patch latent image by the toner replenishing control, is changed. In this manner, the toner replenishing control can be performed by the latent image contrast corresponding to the environment at that time. Further, at this time, a gradation control is also executed, and by finding the latent image contrast in each gradation, a control to maintain a desired gradation characteristic can be performed.

Here, when a periodic control for deciding the latent image contrast according to this environment is performed by the patch of the maximum image density in the predetermined density, that is, the maximum image density developed image, a scope of the detection density is broadened out and becomes preferable, and thus, the periodic control is often executed as a so-called maximum image density control (Dmax control). Since the Dmax control takes a time to execute in a pre-rotation for every image formation, at the rising time of the apparatus and after having risen the apparatus, the Dmax control is executed at periodically determined intervals depending on the number of image formation sheets and time.

That is, at the drastically changed time of an apparatus environment or at the initial density setting time by the developer inside the developing apparatus or at the rise time of the apparatus after replenishment or replacement of the developer from the outside, the-maximum image density control is executed, so that the latent image contrast set up by such maximum image density control according to the detection value of the environmental sensor by the subsequent toner replenishing control is used and controlled so as to become a reference density for the entire environment.

However, in recent years, because of a trend toward a high image quality, the toner and carrier inside the developer come to become small in diameter, and a superficial area as the developer becomes large, and a moisture conditioning time of the developer tends to be long.

Hence, in case the installing environment of the apparatus drastically changes, the developer is not sufficiently moisture-conditioned, and before the tribo becomes a value corresponding to a moisture amount detected by the environmental sensor, a so-called environmental mismatch state, in which a patch image detection timing in the maximum image density control is invited, occurs. That is, in this maximum image density control, a situation where the environment and the latent image are set in a mismatched state occurs. Particularly, at the installing time of the image forming apparatus, and at the initial setting time of the patch image detection right after the replacement of the developer, this environmental mismatch state tends to occur.

To be specific, when the developer is filled in the developing container of the developing apparatus at the setting time of the apparatus and at the replacing time of the developer, and the like, a moisture amount (water mass contained in the air of 1 $m^3$) inside the developing container depends on the environment at the filling time, and in general, the amount fluctuates from 1 g to 20 g. In the meantime, similarly, since the inside of the replenishment container installed in the image forming apparatus is hermetically sealed, the moisture amount inside the container is hardly changed for a long period of time.

For example, in a state in which the moisture amount inside the replenishment container is 20 g, and in the initial period, when the toner is filled in an empty developer container from this container, in case the detection moisture amount of the environmental sensor is 1 g, though the latent image contrast is outputted at a value corresponding to the moisture amount of 1 g which is the detection value of the environmental sensor, since an actual frictional charging amount of the developer is a value corresponding to the moisture amount of 20 g inside the replenishment container, a phenomenon that the patch image density is sharply deviated from the reference density occurs.

As a result, the initial density setting is incapacitated, and even when the density setting is attempted, since it is deviated from the reference density, it is small in sensitivity, and a desired image density is not achieved by the latent image contrast set at the maximum image density control time.

Hence, in the course of the developer being moisture conditioned, a problem arises because of a non-moisture conditioned developer. For example, the patch density is detected thin by the change of the tribo, and the toner density of the developer is set high, so that the problems such as a fogging, a toner flying, and in the worst case, a spilling out of the toner from the developing apparatus are brought about.

Hence, in Japanese Patent Application Laid-Open No. H10-83115, a proposal is made in which a state quantity regarding developing characteristics, for example, the maximum toner adhering amount capable of image formation, a developing starting voltage, and the like are calculated, so that at least one of the processing such as agitation of the developer of the developing means, the toner replenishment, and the toner consumption is executed, thereby executing a developer aging so as to adjust a developer state.

However, in the developer aging executing time, every time the image formation is executed, the toner density is required to be changed until it becomes a desired developing characteristic, and further, for such setting, it requires a long period of time, so that there arises a problem of the rising time becoming long.

Further, in Japanese Patent Application Laid-Open No. 2001-194837, a proposal is made in which, at the initial density setting time of the patch image, regardless of the moisture amount detected by the environmental sensor, the patch image is formed by developing the patch latent image formed by the predetermined latent image contrast, and based on this image density, an image density output setting is made. In this method, there is outwardly no problem of the developer being non-moisture conditioned.

However, according to this method, though a patch image is formed by a constant latent image contrast, the predetermined value thereof is set regardless of a degree of the moisture conditioning in the developer, and though there occurs a mismatch with an ideal latent image contrast shown by the environmental sensor, there is no mention made of a counter measure to meet such a mismatch.

Further, in Japanese Patent Application Laid-Open No. S63-177177, a proposal is made in which a hysteresis of the outputs of the detecting means in a plurality of timings within the past predetermined period of times is stored, and for example, in the case of the installation time of the developing apparatus into the image forming apparatus and the total replacement time of the developer inside the developing apparatus according to the stored plurality of data, a moisture absorption state of the developer is presumed according to the similar state of the data, and the image forming condition is controlled according to the moisture absorption state.

However, in an environmental fluctuation from beneath low moisture to beneath high moisture and the environmental fluctuation from beneath high moisture to beneath low moisture, there is a difference between an ejecting velocity of the moisture and the moisture absorption velocity in the developer, which is difficult to control.

Hence, in Japanese Patent Application Laid-Open No. 2002-6684, a proposal is made in which a plurality of patch images are formed, and the latent image contrast (Dmax control) as well as a γ-LUT (Dhalf control) are corrected.

However, in the above described control, there is a problem that no mention is made of means of guaranteeing a developer characteristic change based on a tribo change of the developer at the stage in which the developer is moisture conditioned.

Describing more in detail, in case the developing apparatus is transferred under low temperature low moisture environment (NL) in a moisture conditioned state under high temperature high moisture (HH) environment, at that point, the environmental sensor estimates that the tribo of the developer is high since the apparatus is under the NL, and determines that a high latent image contrast is required. Nevertheless, as described above, since the developer is not yet sufficiently moisture conditioned, the tribo is low, and the developing property is in a high state. Consequently, in the latent image contrast presumed from the environmental sensor, a situation occurs in which the density is outputted thick. Hence, by executing the Dmax control, the latent image contrast actually used is set to a low value again, so that the density can be set constant. However, when the developer is gradually moisture conditioned to the tribo under the NL, since the tribo rises up and the developing property lowers, an output is not made in the maximum image density by the Dmax control previously performed with a result that a replenishment excessive signal is transmitted. As a result, the TD ratio is increased and a fogging phenomenon sometimes occurs.

That is, instead of the latent image contrast becoming large because of becoming a high tribo under the NL, the tribo of the developer is in a low tribo state by the developer of the high toner density, and as a result, the control often ends up becoming inconsistent by being controlled in a low state of the latent image contrast.

SUMMARY OF THE INVENTION

An object of the present invention is to provide an image forming apparatus capable of a steady developer density control and an image density control even in case an apparatus installation environment drastically changes and an environmental mismatch occurs before-and-after the replacement of a developer into a new container in the installing time of the image forming apparatus and the replacing time of the developer even when a two-component developer is a type of taking a long time for moisture conditioning.

The image forming apparatus to achieve the above described object comprises:

image forming means for forming an electrostatic image on an image bearing member;

a developing apparatus for containing a developer including a toner and a carrier, and developing the electrostatic image;

developer density detecting means of detecting the density of the developer inside the developing apparatus;

image density detecting means of detecting the density of a developed image developed by the developing apparatus;

environmental detecting means of detecting a state of the environment where the apparatus itself is placed;

developer replenishing means of replenishing a replenishment developer including at least the toner for the developing apparatus; and control means of performing:

a replenishing operation control capable of controlling a developed image which develops by the developing apparatus a replenishing control electrostatic latent image formed on the image bearing member by a replenishing operation of the developer replenishing means based on a result detected by the image density detecting means; and image density control for controlling by the electrostatic image forming condition the developed image which develops by the developing apparatus the image density control electrostatic image formed on the image bearing member based on a result detected by the image density detecting means;

wherein, in case the detection result by the environmental detecting means is changed by more than predetermined value or the replenishment developer is renewed, the control means, not based on a result detected by the image density detecting means, but based on the detection result of the developer density detecting means, advances to a mode of performing the image density control, while performing the replenishing operation by the developer replenishing means.

DESCRIPTION OF THE PREFERRED EMBODIMENTS

An image forming apparatus according to the present invention will be described below in detail with reference to the drawings.

First Embodiment

Figure 9:
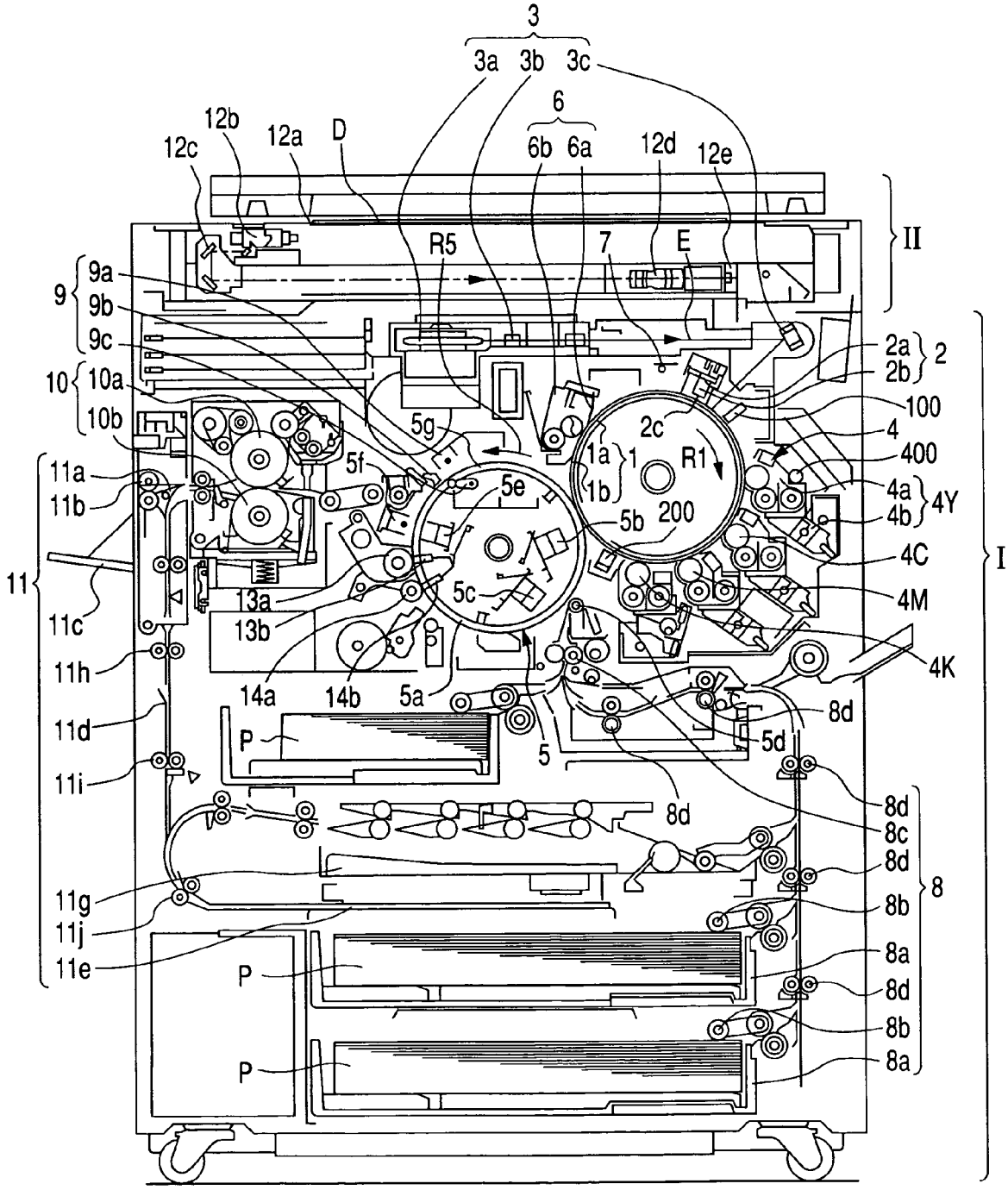
FIG. 9 is a schematic block diagram showing one example of the image forming apparatus according to the present invention.

FIG. 9 is a cross-sectional view showing one example of an image forming apparatus adapted to the present invention, which is a full color image forming apparatus of four colors of an electrophotostatic digital system. This is just one example only, and the whole structure of the image forming apparatus is considered to include other various types.

The present image forming apparatus comprises a digital color image printer portion I of the under part, and a digital color image reader portion II of the upper part, and for example, based on the image of an original D read by the reader portion II, an image is formed on a recording material P by the printer portion I.

The constitutions of the printer portion I and the reader portion II, and an image forming operation to be executed will be described below.

The printer portion I has a photosensitive drum 1 as an image bearing member rotationally driven in the direction of an arrow mark R1. Around the photosensitive drum 1, there are disposed in order along the rotational direction a primary charging device 2, exposing means 3, an developing apparatus 4, a transferring apparatus 5, a cleaning device 6, and image forming means acting on the photosensitive drum 1 such as a pre-exposing lamp 7, and the like. Down below the transferring apparatus 5, that is, a lower half portion of the printer portion I is disposed with a sheet feeding conveying portion 8 of a recording material P, and the upper portion of the transferring apparatus 5 is disposed with separating means 9, and further, the downstream side (downstream side in the conveying direction of the recording material P) of the separating means 9 is disposed with a fixing device 10 and a discharging portion 11.

Further, in addition to these image forming means, there is disposed an unillustrated environmental sensor in the vicinity of the developing apparatus 4 of the printer portion I.

The photosensitive drum 1 has a drum-shaped base member 1*a* made of aluminum and a photosensitive layer 1*b* of OPC (organic photo conductor) covering the surface thereof, and is rotationally driven in the direction of an arrow mark R1 by unillustrated driving means at a predetermined process velocity (peripheral velocity), and in the course of the rotation, a developed image (toner image) is formed on the surface.

The primary charging device 2 which is charging means is constituted as a coronal charging device comprising a shield 2*a* opened at a portion opposing to the photosensitive drum 1, a discharge wire 2*b* disposed in parallel with a bus line of the photosensitive drum 1 inside of the shield 2*a*, and a grid 2*c* regulating a charge potential disposed at the opening portion of the shield 2*a*. The primary charging device 2 is applied with a charging bias by a power source not shown, and in this manner, the surface of the photosensitive drum 1 is uniformly charged to a predetermined polarity and a predetermined potential in a charging process.

The exposing means 3 comprises a laser output portion (not shown) for emitting a laser light based on the image signal from the reader portion II, a polygon mirror 3*a* for reflecting a laser light, a lens 3*b*, and a mirror 3*c*. The exposing means 3 exposes the surface of the uniformly charged photosensitive drum 1 by irradiating this laser light by the primary charging device 2, and forms an electrostatic latent image on the surface of the photosensitive drum 1 by removing the charge from the exposed portion in an latent image forming process which is an exposing process in the present embodiment. In the present embodiment, the image of the original D is color-separated into four colors of yellow, cyan, magenta, and black, and electrostatic latent images corresponding to each color are formed in order on the surface of the photosensitive drum 1.

As the developing apparatus 4, four pieces of developing apparatuses 4Y, 4C, 4M, and 4K are provided, and each apparatus contains a two-component toner including toners of yellow (Y), cyan (C), magenta (M), and black (K) based on resin. Each of the developing apparatuses 4Y to 4K has a developing sleeve 4*a* which bears the toner and conveys it to the photosensitive drum 1 opposed to the developing portion, respectively, and the developing apparatus of a predetermined color provided for the development of an electrostatic latent image is alternatively disposed at a developing position close to the surface of the photosensitive drum 1 by an eccentric cam 4*b*, and in the developing process, allows the toner to adhere on the electrostatic latent image through the developing sleeve 4*a* so as to be developed, thereby visualizing the toner image as the electrostatic latent image.

Further, inside each of the developing apparatuses 4Y to 4K, there is disposed (FIG. 5) an optical TD ratio detection sensor N1, which is a developer density detecting means capable of detecting the developer density inside the developing apparatus. Further, in the present embodiment, though the optical sensor is used as the TD ratio detection sensor, in addition to this, a permeability sensor may be used, and outside of the developing apparatus, a sensor may be provided.

At the developing time, three developing apparatuses 4 other than the developing apparatus 4 provided for the developing process are at a retraction position separated from the developing position. Further, the developing apparatus 4, based on the detection result of this TD ratio detection sensor, is used at the toner replenishing control time when the toner is replenished from the replenishment container 400 contained with the replenishment toner, which is provided in the vicinity of each of the developing apparatuses 4Y to 4K. The details thereof will be described later.

The transferring apparatus 5 comprises a transferring drum (recording material bearing member) 5*a* for bearing a recording material P of the transferring material on the surface, a transferring charging device 5*b* for transferring the toner image on the photosensitive drum 1 onto the recording material P in a transferring process, an attracting charging device 5*c* for electrostatically attracting the recording material P onto the transferring drum 5*a* and an attracting roller 5*d* opposing to the device 5*c*, an inside charging device 5*e*, and an outside charging device 5*f*. A peripheral opening region of the transferring drum 5*a* journaled so as to be rotationally driven in the direction of an arrow mark R5 is cylindrically integrally spanned with a recording material bearing sheet 5*g* formed of a dielectric material. The recording material bearing sheet 5*g* uses a dielectric sheet such as a polycarbonate film and the like.

The cleaning container 6 comprises a cleaning blade 6*a*, which scrapes off the residual toner not transferred on the recording material P but remained on the surface of the photosensitive drum 1, and a recovery container 6*b* for collecting the scraped toner.

The pre-exposing lamp 7 is disposed adjacent to the upstream side of the primary charging device 2, and removes an unnecessary charge on the surface of the photosensitive drum 1 cleaned by the cleaning contain 6.

The sheet feeding conveying portion 8 comprises a plurality of sheet feeding cassettes 8*a* for stacking and storing the recording materials P of different sizes, a sheet feeding roller 8*b* for feeding the recording material P inside the sheet feeding cassette 8*a*, a plurality of conveying rollers 8*d*, a registration roller 8*c*, and the like, and supplies the recording material P of a predetermined size to the transferring drum 5*a*.

The separating means 9 comprises a separating charging device 9*a* for separating the recording material P after being transferred with the toner image from the transferring drum 5*a*, a separating claw 9*b*, a separating pushing roller 9*c*, and the like.

A fixing device 10 comprises a fixing roller 10*a* having a heater inside, and a pressure roller 10*b* which pushes the recording material P disposed down below the fixing roller 10*a* to the pressure roller 10*a*.

The discharging portion 11 comprises a conveying pass switching guide 11*a* disposed in the downstream side of the fixing device 10, a discharging roller 11*b*, a discharging tray

11*c*, and the like. Down below the conveying pass switching guide 11*a*, there are disposed a conveying vertical pass 11*d* for performing the image formation on both surfaces of one sheet of the recording material P, a reverse pass 11*e*, an intermediate tray 11*g*, and moreover, conveying rollers 11*h* and 11*i*, a reverse roller 11*j*, and the like.

Between the primary charging device 2 and the developing apparatus 4 around the photosensitive drum 1, there is disposed a potential sensor 100 for detecting a charging potential on the surface of the photosensitive drum 1, and between the developing apparatus 4 and the transferring drum 5*a*, there is disposed an image density detecting means (image density sensor) 200 for detecting the density of the toner image on the photosensitive drum 1, respectively. The image density sensor 200 will be described in detail later.

The reader portion II disposed above the printer portion I comprises an original table glass 12 mounting the original D, a exposing lamp 12*b* for expose-scanning the image surface of the original D while moving, a plurality of mirrors 12*c* for further reflecting the reflected light from the original D, a lens 12*d* for converging the reflected light, a full color sensor 12*e* for forming a color-separated color image signal based on the light from the lens 12*d*, and the like. The color-separated color image signal is given treatment by a video processing unit (not shown) through an amplifier circuit (not shown), and is sent to the printer portion I.

In the image forming apparatus thus constituted, four color full-color images of yellow, cyan, magenta, and black are supposed to be formed in order. This image forming process will be described.

The image of the original D mounted on the original table glass 12*a* of the reader portion II is irradiated by the exposing lamp 12*b*, and after being color-separated, first, the image of yellow is read by the full color sensor 12*e*, and is subjected to a predetermined processing, and is sent to the printer portion I as an image signal.

In the printer portion I, the photosensitive drum 1 is rotationally driven in the direction of an arrow mark R1, and first, in the charging process, the surface is uniformly charged by the primary charging device 2. In the exposing process, based on the image signal sent from the reading portion II, a laser light is irradiated from a laser output portion of the exposing means 3, and the surface of the charged photosensitive drum 1 is exposed by an optical image E through the polygon mirror 3*a* and the like. The portion, which receives the exposure of the surface of the photosensitive drum 1, is eliminated from the charge, so that an electrostatic latent image corresponding to a yellow component color is formed. In the developing process, in the developing apparatuses 4, the developing apparatus 4Y of yellow is disposed at a predetermined developing position, and other developing apparatuses 4C, 4M, and 4K are retracted from the developing position. The electrostatic latent image on the photosensitive drum 1 is adhered with a yellow toner by the developing apparatus 4Y, and is developed as a yellow toner image. This yellow toner image on the photosensitive drum 1 is transferred onto the recording material P borne on the transferring drum 5*a* in the transferring process.

In the transferring process, the recording material P is supplied in a size adequate to the original image to the transferring drum 5*a* at a predetermined timing from a predetermined sheet feeding cassette 8*a* through the sheet feeding roller 8*b*, the conveying roller and registration roller 8*c*, and the like. The recording material P thus supplied is attracted by and wound around a transferring material bearing sheet 5*f* on the surface of the transferring drum 5*a*, and is rotated accompanied with the rotation in the direction of the arrow mark R5 of the transferring drum 5*a*, and is transferred with the yellow toner image on the photosensitive drum 1 by the transferring charging device 5*b*.

The photosensitive drum 1 after being transferred with the toner image is removed from the residual toner on the surface by the leaning device 6, and further removed from an unnecessary charge by the pre-exposing lamp 7, and is provided again for image formation subsequent to the above described primary charging.

A series of processes from the reading of the image of the original D by the reading portion II until the transferring of the toner image onto the recording material P located on the transferring drum 5*a*, the cleaning of the photosensitive drum I, and charge elimination are performed similarly for other three colors in addition to yellow, that is, cyan, magenta and black, thereby obtaining a color image in which the toner images of four colors of yellow, magenta, cyan, and black are overlaid on the recording material P on the transferring drum 5*a*.

The recording material P transferred with four color toner images is separated from the transferring drum 5*a* by the separating charging device 9*a*, the separating claw 9*b*, and the like, and is conveyed to the fixing device 10 in a state in which an unfixed toner image is borne on the surface.

The recording material P, in the fixing process, is heated and pressured by the fixing roller 10*a* and the pressure roller 10*b* of the fixing device 10, and the toner image is fused and stuck on the surface of the recording material P, and is fixed. The recording material P after being fixed is discharged on the discharging tray 11*c* by the discharging roller 11*b*.

In case an image is formed on both surfaces of the recording material P, immediately after the recording material P comes out from the fixing device 10, the conveying pass switching guide 11*a* is driven, and after the recording material P is guided once to the reverse pass 11*e* through the conveying vertical pass 11*d*, the trailing end of the recording material P at the time when it is fed into by a reverse rotation of the reverse roller 11*j* is placed at the head, and it is allowed to exit in a direction opposite to the feeding direction, and is stored in the intermediate tray 11*g*. After that, an image is formed again on the other surface of the recording material P by the image forming process, and then, it is discharged on the discharge tray 11*c*.

The transferring drum 5*a* after being separated from the recording material P is cleaned by a fur brush 13*a* and a back up brush 13*b* opposed to each other through the recording material bearing sheet 5*g* as well as an oil removal roller 14*a* and a back up brash 14*b* to prevent flying and adherence of fine particles on the recording material bearing sheet 5*g*, adherence of oil on the recording material P, and the like. Such a cleaning is performed before and after the image formation, and further, when a jam (paper jam) develops, it is performed as occasion demands.

Here, at the pre-rotation time of such an image forming process, the toner replenishing control as described in the conventional example is executed. Further, at the rise time of the apparatus or according to the subsequent change of environment, the toner replenishing control together with the maximum image density control are periodically executed, and the latent image contrast used in the toner replenishing control is corrected.

Figure 3:
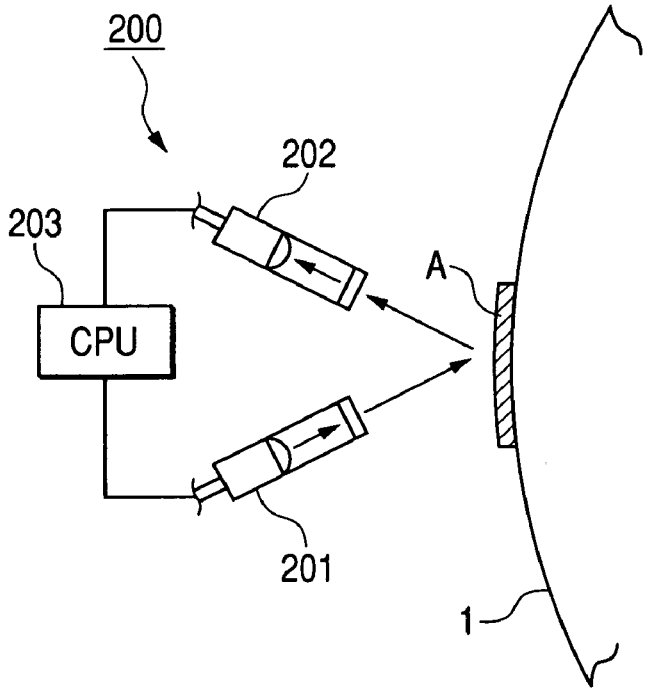
FIG. 3 is a schematic block diagram showing one example of image density detecting means according to the present embodiment.

The image density detecting means (image density sensor) 200 for detecting the image density (patch density) of the density detection developed image (patch) and the maximum image density developed image (maximum image density patch) formed on the photosensitive drum 1 which is used in this toner replenishing control and the maximum image density control is, as shown in FIG. 3, a light sensor comprising a light emitting portion 201, a light receiving portion 202, and a CPU 203. An irradiating light emitted from the light emitting portion 201 is reflected by a patch image A formed on the photosensitive drum 1, and its reflected light is received by the light receiving portion 202. The light amount of the received reflected light is converted into an output voltage through the CPU 203.

The maximum image density developed image (maximum image density patch) is formed by the maximum image density which can be periodically outputted at the rise time of the apparatus, and the latent image contrast which becomes a reference in that environment is found, and a gradation control is further executed.

The patch image A used for the toner replenishing control exposes the surface of the charged photosensitive drum 1 by the laser light of the exposing means 3 by the latent image contrast set by the maximum image density control so as to form the density detection electrostatic image (patch latent image),and develops that patch latent image by the developing apparatus 4 and takes it as an toner image.

Figure 4:
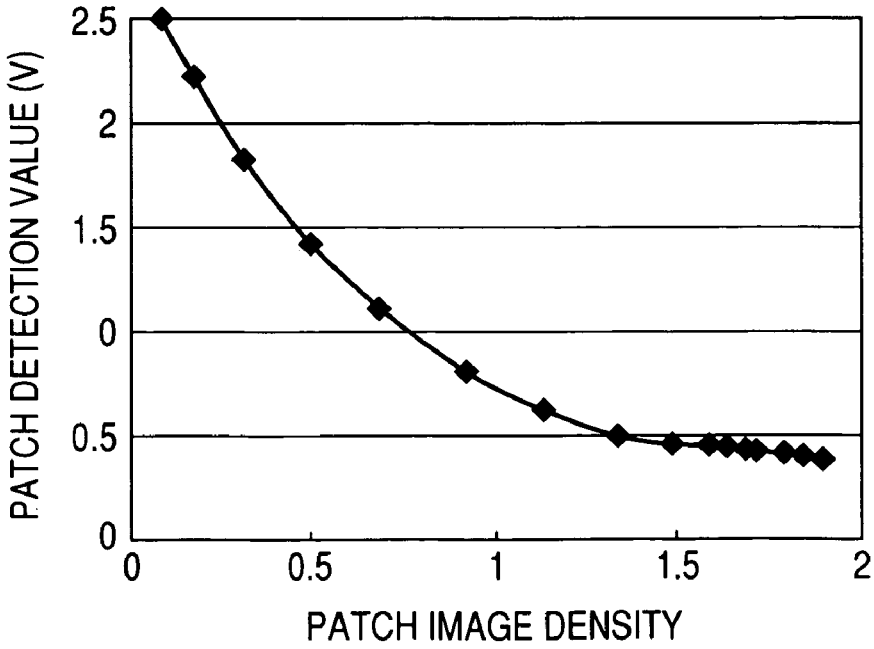
FIG. 4 is a graph showing a relation between an image density detecting means output value and an image density.

The density of the patch image A at this time can be relatively easily changed, for example, by changing the latent image contrast (difference between the surface potential and the background potential of the image portion) by the strength of the laser light. In FIG. 4 is shown an output voltage characteristic of the patch image density and the image density sensor 200. In the present embodiment, the maximum image density control is executed, and after the gradation control is executed, the patch image is formed by the latent image contrast corresponding to an optical density of 0.6, which is the highest in sensor sensitivity. After that, based on the density detection result of this patch image, the toner replenishing control is performed so as to bring about the most adequate density corresponding to the photo density of 0.6. Naturally, in addition to a setting of the optical density of 0.6, a reference is formed by selecting a patch image of the most adequate density setting from the developer characteristic, the sensor sensitivity, and the like, so that a good control can be achieved.

It is preferable that there is a density difference between the patch image formed in the toner replenishing control and the maximum image density patch in the maximum image density control. The reason why is because, in the image of high density such as the maximum image density patch, a sensor sensitivity is not good, and irregularity of the TD ratio becomes large, so that violent fluctuations of the density tend to occur. Further, when the patch image is recovered into the cleaning container 6 of the photosensitive drum 1, in case the image of a certain portion in which the density is locally high is continuously recovered into the cleaning container 6, a local chattering of the cleaning blade 6*a* is generated at a toner present portion and a toner absent portion, and in the worst case, there is a possibility of causing a cleaning defect. Further, when the patch image is a sold black patch in the toner replenishing control, a toner consumption amount is increased, and an increase of running cost is brought about.

In case the developing apparatus 4 determines that the toner image density is thin from the detection result of the patch image density of the optical density of 0.6 in the toner replenishing control, the developer container of each of the developing apparatuses 4Y to 4K is replenished with the toner from the replenishment container 400 contained with the replenishment toner provided in the vicinity.

Here, the replenishment of the toner from the replenishment container 400 to the developing apparatus 4 is performed based on the patch image detection result in the toner replenishing control, and this replenishing means will be described below.

Figure 5:
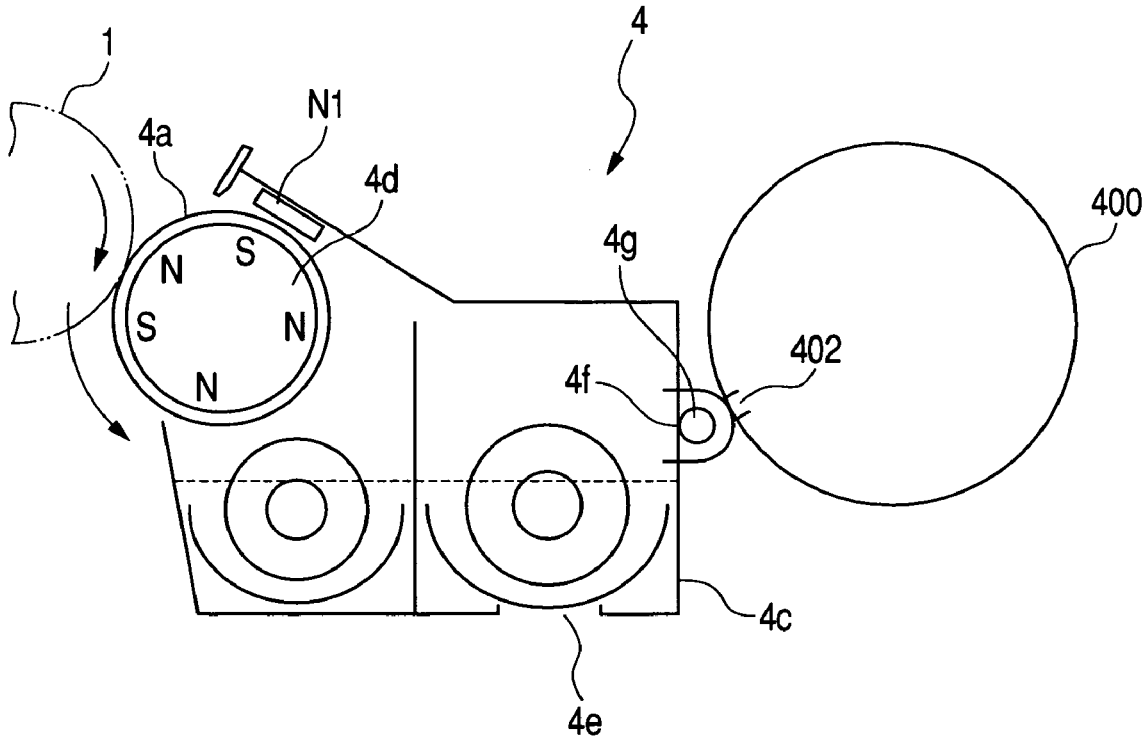
FIG. 5 is a sectional view showing one example of a developing apparatus and a replenishment container according to the present invention.

First, using FIG. 5, the developing apparatus 4 of the present embodiment will be described. Any of the developing apparatuses 4Y, 4M, 4C, and 4K is of the same constitution. In the developer container 4*c* constituting the developing apparatus 4, there is contained a two-component developer including a non-magnetic toner and a magnetic carrier. The toner density in the developer of an initial state is 7 Wt %. This value is supposed to be adequately adjusted according to a charging amount of the toner, a carrier diameter, a constitution of the image forming apparatus, and the like, and does not necessarily comply with this numerical value.

The developing apparatus 4 is opened at a developing region opposed to the photosensitive drum 1, and in this opening portion, the developing sleeve 4*a* which is the developer bearing member is rotatably disposed so as to be partially exposed. The developing sleeve 4*a* containing a fixed magnet 4*d* which is magnetic field generating means is constituted by a non-magnetic cylinder, and is rotated in the direction of an arrow mark of FIG. 5 at the developing operation time, and holds the two component developer in layers inside a developer container 4*c* and bears and conveys it to the developing region, and supplies the two component developer to the developing region opposed to the photosensitive drum 1, thereby developing the electrostatic latent image formed by the above described method on the photosensitive drum 1.

Further, the developer container 4*c* is provided with the developer discharge port 4*e* and a developer replenishing port 4*f*, and usually each of the opening portions is closed by a cap of a rubber material, and at the replacement time of the two component developers, the two component developer inside the developer container 4*c* is discharged from the developer discharge portion 4*e*, and the replenishment of a new developer is performed from the replenishment container 400 by the developer replenishing port 4*f*.

Figure 6:
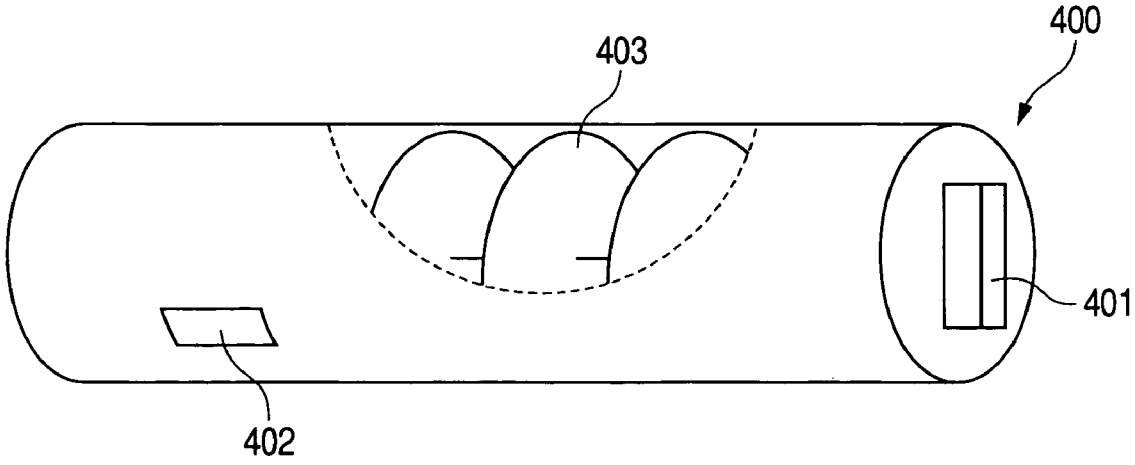
FIG. 6 is an oblique view showing one example of the replenishment container according to the present invention.

The replenishment container 400, as shown in FIG. 6, is a toner cartridge, which is approximately cylindrical and easily detachably attachable from the image forming apparatus itself. The toner cartridge 400 is inserted into the image forming apparatus from this side, and a handle 401 of this side is twisted to the right side so as to be rotated, and the replenishing port 402 is opened. When the toner cartridge 400 is disengaged from the image forming apparatus, the handle 401 is twisted to the left side, so that the replenishing port 402 is closed, and the fine particles contained inside never leak out.

Further, inside the toner cartridge 400, there is built a conveying member 403 for conveying the replenishment toner. In FIG. 6 is partially shown the interior of the toner cartridge 400. As shown in the drawing, an agitating member 403 is a member made of a plastic resin and the like which are spirally wound and rotationally driven by a rigid shaft, and conveys the toner inside the toner cartridge 400 by adequately rotating so as to assist the replenishment. The toner passes through the developer replenishing port 402 from the developer cartridge 400 by the torque and gravitation of the agitating member 403, and is conveyed to a replenishment screw 4*g* disposed at the developer container 4*c*, and accompanied with the rotation of the replenishment screw 4*g*, is replenished inside the developer container 4*c* from the developer replenishing port 4*f*. When the toner is replenished into the developing apparatus 4 by control means of the apparatus, a signal to rotate the replenishment screw 4*g* is transmitted.

In the meantime, in the present embodiment, at the maximum image density control time, by changing the strength of the laser light so as to change the latent image contrast, the patch image density is changed, but in that case, since the density changes depending on the moisture amount of the developer, the moisture amount of the atmosphere of the image forming apparatus is detected by the environmental sensor, and the fluctuating portion by that moisture amount is excluded, and the latent image contrast is controlled. A latent image contrast table found by the Dmax control in such environment is stored by the storage means of the control means for controlling the image forming means each time.

However, in case the environmental sensor determines that the apparatus environment is drastically changed or at the initial density setting time when the developer inside the developing apparatus is renewed in a large amount, there is a possibility that the environmental mismatch as described in the conventional example occurs. For example, by providing a memory in which an environmental hysteresis is stored, the environmental sensor can detect a drastic change of the apparatus environment, and further, if a switch is provided, in which the apparatus can be notified of the developer replacement by hard and software switches by a serviceman, the detection can be made that it is the initial density setting time.

In the present embodiment, in case the environmental sensor determines that the apparatus environment is drastically changed, or at the initial density setting time, the process advances to the mode of confirming whether or not the environmental mismatch occurs.

When the environmental mismatch occurs, to correct this, the process advances to the maximum image density control priority mode to be described later.

Next, a countermeasure method adapted at the environmental mismatch time, which is a feature of the present invention, will be described.

The method of advancing to the environmental mismatch determination routine and the maximum image density control priority mode will be described by using FIGS. 1 and 2.

Figure 1:
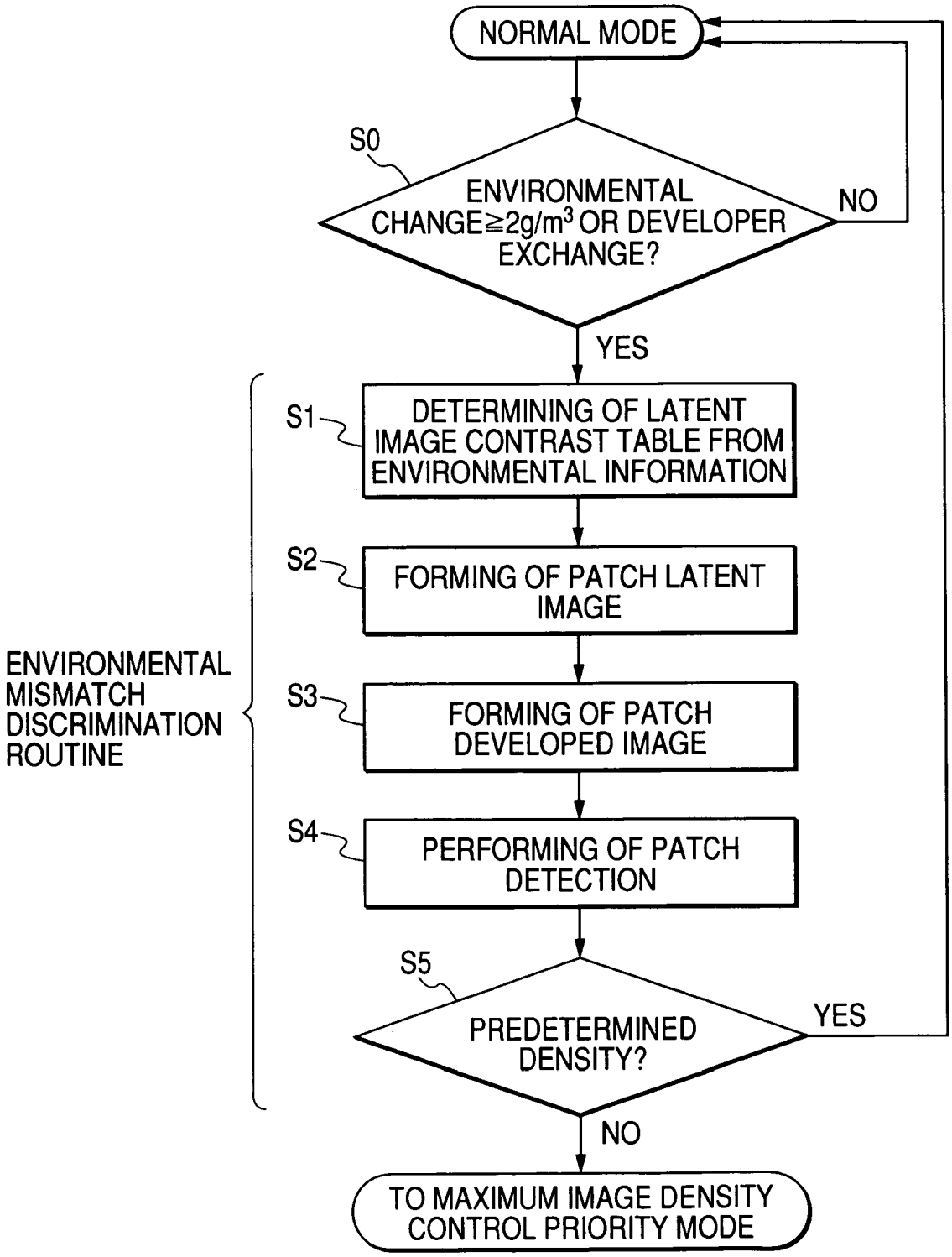
FIG. 1 is a flowchart showing a preparatory process up to executing one example of a maximum image density control priority mode according to the present invention.

First, as described above, in accordance with the flowchart shown in FIG. 1, in case it is determined from a detection result of the environmental sensor that a drastic apparatus environmental change occurs or the developer replacement operation is performed, in other words, in case it is determined that the drastic environmental change occurs in the normal mode, that is, in case the detection result by the environmental sensor causes a change of more than a predetermined value comparing to the previous image forming time, or when a signal to the effect that the developer is renewed is transmitted to the control means (S0), the process advances to the environmental mismatch routines (S1 to S5).

Here, at S0, in the case of the environmental change, a reference to determine whether or not it is the drastic environmental change is a variation from the environmental detection result at the pre-rotational time of the previous image forming process in the absolute moisture amount in the present embodiment, and when a change equal to or more than the absolute moisture amount of 2 $g/m^3$ as a predetermined value occurs, it is determined that the drastic environmental change occurs. If this setting value is set to 1 $g/m^3$ or 0.5 $g/m^3$, it is only natural that much accurate and good control can be executed.

The environmental mismatch determination routine executes the following steps of S2 to S6.

S1: From the detection result of the environmental detecting means, a latent image contrast group in the same environment stored in the storage means of the image forming apparatus is decided.

S2: With reference to the latent image contrast group selected by S1, a patch latent image set to the density of 0.6 is formed.

S3: The patch latent image formed in S2 is developed, and it is taken as a patch developed image.

S4: The patch image density is detected by the density sensor 200.

S5: It is determined whether or not the density detection result in S4 is the predetermined density. When determined that it is in the range of the predetermined density, here when determined that it is ±0.1 as a density difference, the process returns to the normal mode. That is, the toner replenishing control is performed. In case it is determined that the density detection result in S4 sharply deviates from the predetermined density, that is, the difference is more than ±0.1, it is determined that it becomes an environmental mismatch state, and the process advances to the maximum image density control priority mode, which corrects the image density detection result in this mismatch state.

The maximum image density control priority mode is a control mode for deciding an executing timing of the toner control mode and the Dmax control that are executed until the environmental mismatch thus occurred is solved. Consequently, the flowchart showing the operation of the maximum image density control priority mode in FIG. 2 does not necessarily show one time operation executed when the environmental mismatch occurs, but shows the executing timing as well as the method of the toner control mode and the maximum image density control (Dmax control) executed in the pre-rotation of the image forming process, which are executed from when the environmental mismatch occurs until it is solved.

As a specific operation, in the maximum image density control priority mode, with the developer density detection result provided in the developing apparatus as a reference, the toner replenishing amount is regulated, and the normal toner control mode and the Dmax control which is the maximum image density control, which periodically detects the maximum density and, in order to control this maximum density, controls a charging potential, a developing bias value, and the latent image contrast control, are executed.

Figure 7:
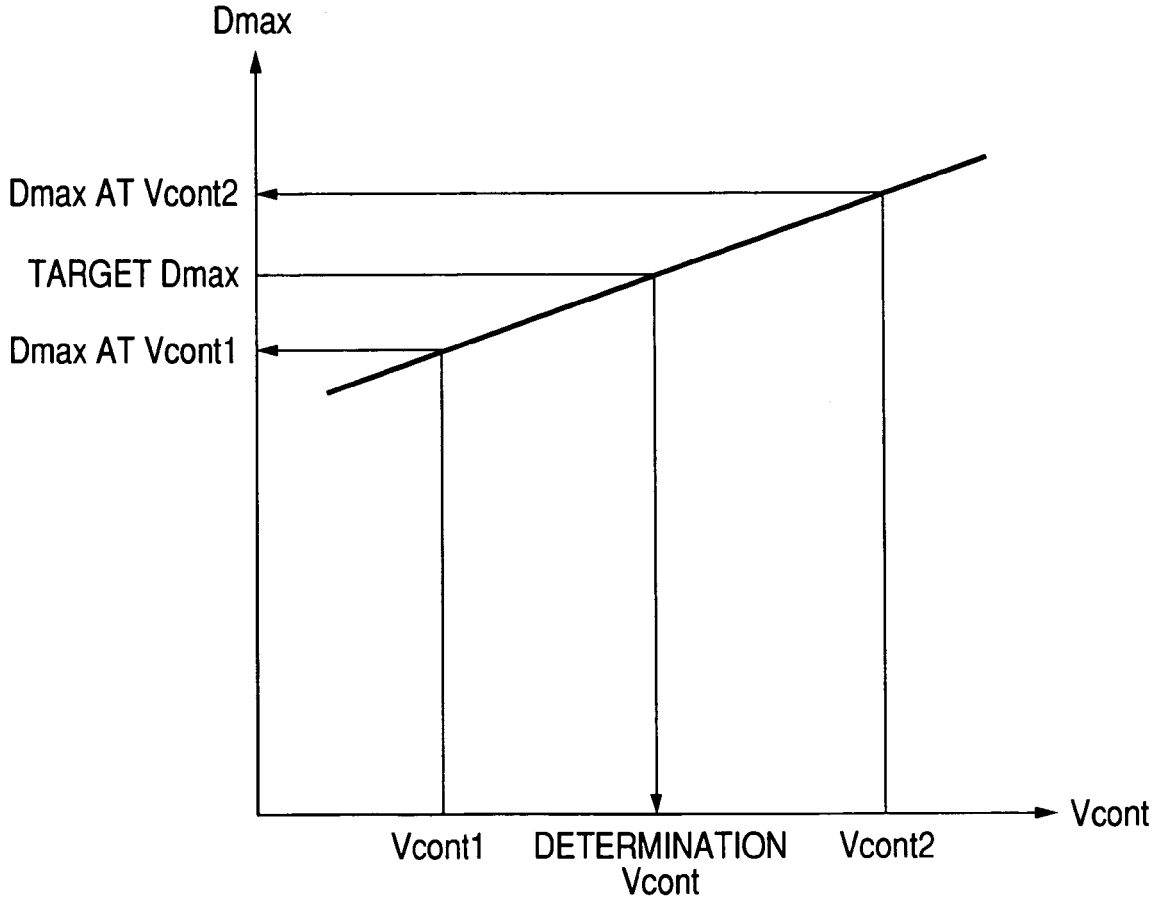
FIG. 7 is a graph showing a relation between the maximum image density and a latent image contrast in the maximum image density control according to the present invention.

The Dmax control to be executed here can be achieved, to be specific as shown in FIG. 7, by forming a plurality of patches having an image ratio of 100% by changing the latent image contrast which is a latent image forming condition, and by deciding a desired contrast potential to become the target maximum image density Dmax which is 1.6 here. By performing the density detection by the maximum image density setting, the output range of the density becomes the maximum, so that the change of the output in the environmental mismatch can be clearly manifested.

Although not describing in detail, since the change of the latent image contrast damages a gradation property, when a gradation (Dhalf) control such as adequately selecting and controlling a γ-LUT, which maintains the gradation property constant, is simultaneously executed, gradation stability can be further attempted.

Here, the operation in the maximum image density control priority mode will be described by using the flowchart shown in FIG. 2. The maximum image density control priority mode executes the replenishing control so as not to deviate from the current TD ratio before executing the maximum image density control.

S6: A signal value TDSgnl at the advancing time to the mode by a developer member density sensor N1 is detected.

S7: Next, upper and lower limiter values are provided for the TD ratio so that the TD ratio at the advancing time to the mode detected in S6, that is, the TDSgnl is maintained. To be specific, in the image forming process until the environmental mismatch is solved, the toner replenishing control and the Dmax control are executed with a value fluctuated by ±0.5 for the TDSgnl which is the TD ratio at the advancing time to the mode taken as the upper and lower limiter. That is, in the later process, the toner replenishing operation from the replenishment container 400 is executed so as to stay within the values of an upper limit TD ratio (UpLmt) and a lower limit TD ratio (LowLmt).

S8: In the image forming process subsequent to the occurrence of the environmental mismatch, it is determined whether or not the detection result TDsgnl by the developer density sensor N1 is below the UpLmt, and when determined that it is below the UpLmt, the process advances to S9. When determined that it is above the UpLmt, the process advances to S81, and the toner replenishing control is stopped in the image forming process, and the process advances to S11.

S9: It is determined whether or not the detection result TDsgnl by the developer density sensor N1 is above the LowLmt, and when determined that it is above the LowLmt, since it is already determined to be below UpLmt at S8, it is taken as within the adequate value, and the process advances to S10. When determined that it is below the LowLmt, since abnormality of the main body, and specifically, breaking of signal wire, trouble of the sensor, and the like are believed to exist, the process advances to S91, and it is determined whether or not this is repeated three consecutive times or more. When it is below three consecutive times, the process advances to S11, but when it is above the three consecutive times and is detected, an error display is made at S92, and this process is completed at S93, thereby making it as a serviceman call.

S10: At S8 and S9, in the image formation at the time when it is determined that the detection result by the developer density sensor N1 is in an adequate range, the toner replenishing control is performed similarly as usual, and the process advances to S11.

S11: It is determined whether or not the pre-rotation time of the image forming process of this time is a timing to execute the Dmax control to be periodically executed. When it is the Dmax control executing timing, the process advances to S12. Here, in case the detection result by the developer density sensor N1 is not an adequate value, the toner replenishing control in S10 is not executed, and the process advances to step S11. When it is not the Dmax control timing, in the image forming process of this time, the Dmax control is not executed, and in the next image forming process, the process starts from S8.

S12: Since it is the Dmax control timing, the Dmax control is executed.

S13: After that, when the latent image contrast which outputs the maximum image density in S12 is approximately equivalent to a predetermined contrast set by the same environmental condition when the environmental mismatching does not occur, the process returns to the ordinary mode from the next image formation, and when it is not equivalent, the replenishing operation is executed from the next image formation, in which the Dmax control is operated at narrower intervals than normally presumed intervals, though one operation for every two hours is set as the operation intervals during the normal mode in the present embodiment, in the maximum image density control priority mode, the operation is set at one half of that, that is, at the intervals of one operation for every one hour.

In the maximum image density control priority mode from S6 to S13 as described above, at a point of time when it is determined that the environmental mismatch occurs, the TD ratio of the developer contained in the developing apparatus 4 at the occurrence time of the environmental mismatch in S6 is detected, and the subsequent image formation is executed until the environmental mismatch is solved so that the ratio does not change. That is, during the execution of this maximum image density control priority mode, even when the replenishing amount is increased or decreased by the toner density control patch, the TD ratio set at S6 is allowed to change as it is, and the Dmax control is preferentially executed.

That is, if the TD ratio is kept constant, since violent density fluctuations end up occurring by deterioration or increase of the developing characteristic according to the moisture conditioning of the developer, in the present mode, the density is stabilized by the Dmax control. At a time of point when the latent image contrast found by the Dmax control becomes a latent image contrast at the non-occurrence time of the environmental mismatch and yet set by the same environment, it is determined that the environmental mismatch state is released. At that point of time, the maximum image density control priority mode is restored to the normal mode.

At this time, the TD ratio limiter previously provided is released from the next time, and the patch control operation is restored so as to become the TD ratio control following the change of the developer tribo, thereby solving the conventional problem of a non-moisture conditioning. Naturally, there is also no problem occurred such as a fogging as described above, a toner flying, and the like.

The scope of the present invention is not intended to be limited to the size, material, shape, and relational position of the component parts and the like of the image forming apparatus as described above, unless specifically mentioned otherwise.

For example, though the present embodiment is constituted such that the patch on the photosensitive drum which is an image bearing member is detected by the image density sensor 200 opposed to the photosensitive drum, the embodiment may be constituted in such a manner as to detect the image density of the patch transferred from the photosensitive drum to a second image bearing member such as a transferring belt. Further, the image density sensor is also not limited to a sensor as described in the present embodiment.

The image forming apparatus may be also constituted by using an intermediate member or may be of a single color image forming apparatus. The number of developing apparatuses is not particularly limited. Further, the apparatus may be of an electrostatic recording system.

Second Embodiment

In the present embodiment, a control for performing the releasing of the developer density sensor limiter values (UpLmt and LoLmt) in stages in the maximum image density control priority mode executed in the first embodiment is added.

In the present embodiment, as shown in Table 1, at a point of time when a potential difference between a latent image contrast (Vmax) calculated by a Dmax control and a latent image contrast (environmental contrast Venv) found by the Dmax control at the non-occurrence time of an environmental mismatch and yet located in the same environment becomes little, it is determined that a moisture-conditioning progresses to some extent, whereby the limiter value of the developer density sensor N1 is released in stages. To be specific, when the difference between the Venv and the Vmax is 50 V, the limiter value is taken as TDSgn 10±0.5, and the smaller the difference is, the wider the scope of the limiter value is taken wide. At a time of point when the latent image contrast found by the Dmax control as described above becomes a latent image contrast at the non-occurrence time of the environmental mismatch in the same environment, the maximum image density control priority mode is restored to the normal mode.

TABLE 1

| | \|Venv − Vmax\|(V) | | | |
|---|---|---|---|---|
| | 0 | 10 | 30 | 50 |
| limiter value | released | ±1.5% | ±1.0% | ±0.5% |

In this manner, useless appearance of an error display is prevented, and further, as each time the moisture conditioning proceeds, the range of the limiter value become wider, and therefore, the control time can be shortened.

That is, by adopting this control system, the relation between the change of the TD ratio and the tribo in the developer can be gently changed, and better TD ratio control and image density control than the first embodiment can be executed.

Third Embodiment

In the present embodiment, in the maximum image density control priority mode described in the first embodiment, in case a mismatch occurs due to a drastic change of environment, the changing of the Dmax control intervals according to the environmental fluctuation ratio is further performed.

As shown specifically in Table 2, in case it is determined that the environmental fluctuation occurs, the control intervals are made short for the Dmax control intervals in the normal mode corresponding to the rate of change of the moisture amount. In Table 2 is shown a case in which the control intervals in the normal mode is taken as 1.

TABLE 2

| | Rate of change of Moisture amount | | | |
|---|---|---|---|---|
| | 10% | 20% | 30% | 30% or more |
| Dmax control intervals | 2/3 | 1/2 | 1/3 | 1/4 |

It is assumed that, the larger the drastic change of the environment is, the more sharply the tribo of the developer fluctuates as the moisture conditioning proceeds, and similarly to the present control, the Dmax control intervals are changed by the rate of change of the moisture amount, so that the developer characteristic change accompanied with the tribo change can be allowed to gently follow suit. Consequently, a good result can be further obtained.

Naturally, when the patch image density detection result by the image density sensor 200 and the like is added to the Dmax controlling timing intervals and is changed, more improvement can be obtained.

Fourth Embodiment

In the present embodiment, an advancing determination from the maximum image density control priority mode as described in the first embodiment to the normal mode as described in the first embodiment is controlled not by the difference between a latent image contrast (hereinafter referred to as [environmental contrast]) found in the normal state in which the above described environmental mismatch does not occur and yet located in the same environmental condition and a latent image contrast potential calculated by the Dmax control, but by a patch image density in the environmental contrast. A description will be made specifically by using the flowchart shown in FIG. 8.

Figure 8:
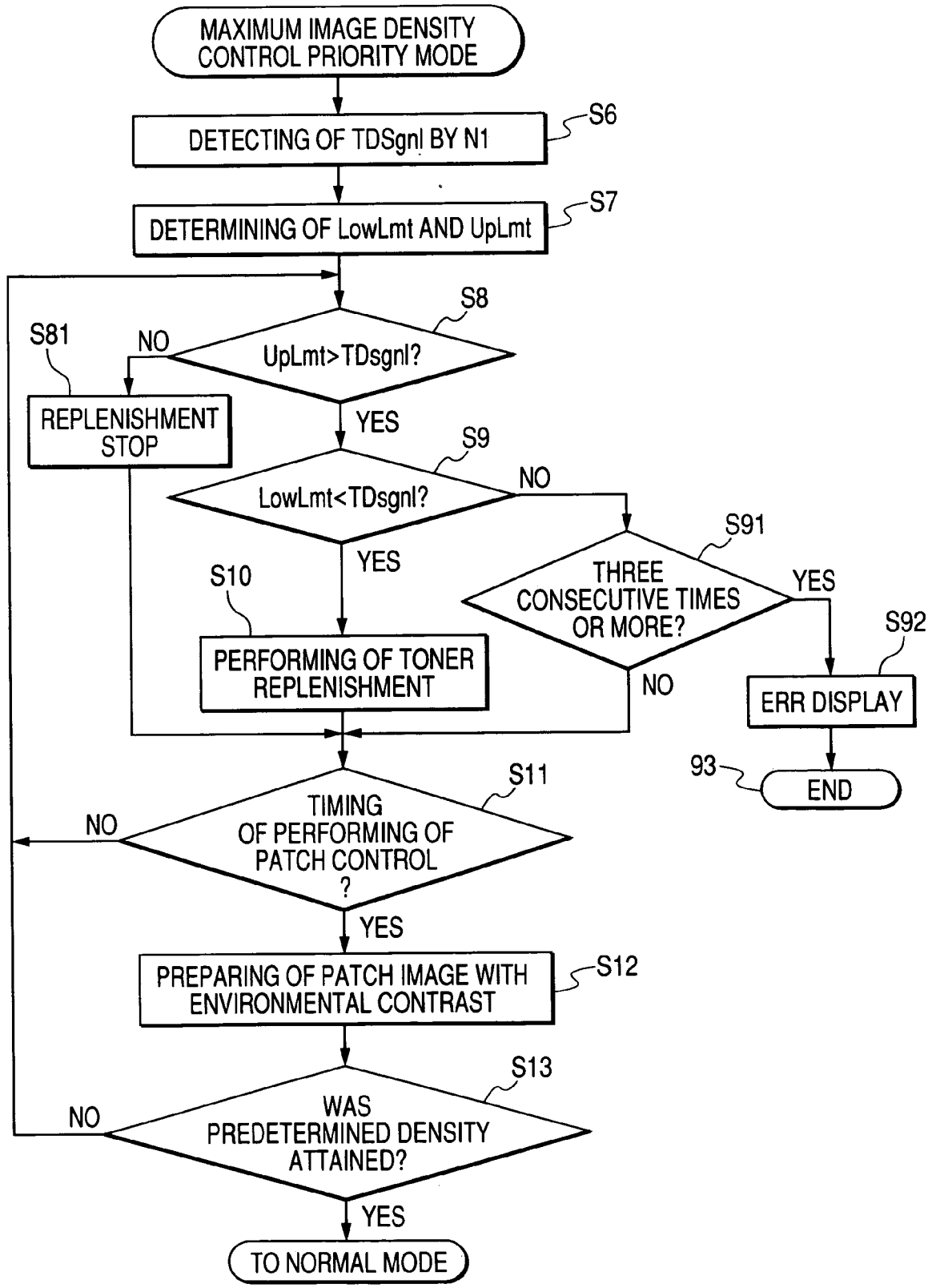
FIG. 8 is a flowchart showing another example of the maximum image density control priority mode according to the present invention.

As evident also from FIG. 8, in the maximum image density control priority mode of the present embodiment, as the Dmax control executed in S12, a patch image is formed and developed by the environmental contrast, and the patch image density is measured by the density sensor 200 in S13. When this measurement result becomes a predetermined density, that is, a density found before the environmental mismatch occurs in the same environment, it is determined that a moisture conditioning is fully progressed, and a control to return to the normal mode is made.

According to the control in the present embodiment, even when the Dmax control as described in the first embodiment is not freshly performed, since a moisture conditioning degree can be determined by the patch image density only, which is formed by the latent image contrast (environmental contrast) found by the Dmax control at the non-occurrence time of the environmental mismatch and yet in the same environment, the Dmax control intervals to be executed subsequently can be broadened, and as a result, a down time is sharply improved.

Figure 2:
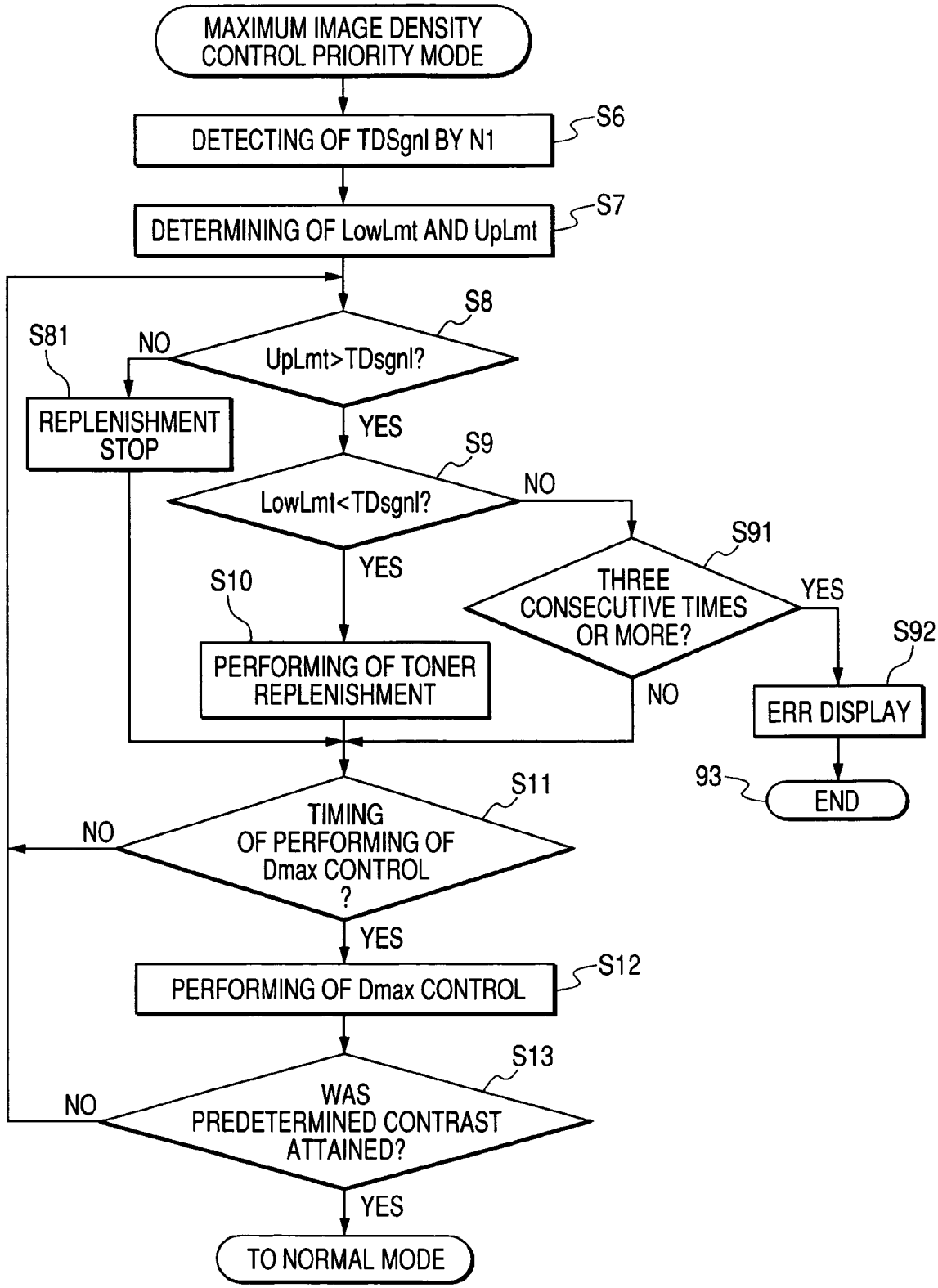
FIG. 2 is a flowchart showing one example of the maximum image density control priority mode according to the present invention.

Here, in the flowchart shown in FIG. 8, though the same control as the Dmax control in S12 of the flowchart shown in FIG. 2 is not executed, since the environmental contrast which becomes the patch image forming condition of S12 of the present embodiment is the latent image contrast decided by the Dmax control in the normal mode, the operation of the present embodiment also can be said to be an operation executed by giving a priority to the Dmax control.

Though not described in detail, by using optimization of the Dmax control intervals and the patch density intervals and the advancing to the normal mode in parallel with the Dmax control result as descried in the first embodiment and the patch image detection result by the environmental contrast of the present embodiment, much excellent control can be achieved.

In the above described embodiments, a description has been made on the constitution in which the toner is replenished from the toner replenishment container to the developing device. However, naturally, the present invention is effective also in the apparatus which uses a mixture of the toner and the carrier mixed at a predetermined ratio as the replenishment developer.

This application claims priority from Japanese Patent Application No. 2004-085692 filed on Mar. 23, 2004, which is hereby incorporated by reference herein.

What is claimed is:

1. An image forming apparatus, comprising:

image forming means for forming an electrostatic image on an image bearing member;

developing apparatus for collecting a developer including a toner and a carrier, and developing said electrostatic image;

developer density detecting means for detecting a density of the developer inside the developing apparatus;

image density detecting means for detecting a density of a developed image developed by said developing apparatus;

environment detecting means for detecting a state of the environment in which the apparatus itself is placed;

developer replenishing means for replenishing a replenishment developer including at least the toner for said developing apparatus; and control means for performing:

a replenishing operation capable of controlling a replenishing operation of said developer replenishing means based on a result of detecting by said image density detecting means a developed image which develops a replenishing control electrostatic image formed on said image bearing member by said developing apparatus, and an image density control for controlling an electrostatic image forming condition of said image forming means based on the result of detecting by said image density detecting means a developed image which develops an image density control electrostatic image formed on said image bearing member by said developing apparatus;

wherein, in case a result of detecting by said environment detecting means is changed by more than a predetermined value or said replenishment developer is renewed, said control means advances to a mode of performing said image density control, while performing a replenishing operation by said developer replenishing means not depending on a result detected by said image density detecting means, but based on a result of detecting by said developer density detecting means.

2. The image forming apparatus according to claim 1, wherein, when said image density control is performed, a frequency of performing said image density control at said mode time is higher than the frequency of performing said image density control at other than said mode time.

3. The image forming apparatus according to claim 1, wherein said image density control electrostatic image is formed as an image having an image ratio of 100 percent.

4. The image forming apparatus according to claim 1, wherein said control means decides upper and lower limit values of a developer replenishing amount at the replenishing operation based on the result of detecting by said developer density detecting means at a time of advancing to said mode.

5. The image forming apparatus according to claim 1, wherein, when an electrostatic image forming condition decided by said image density control at said mode time becomes approximately the same as the electrostatic image forming condition decided by said image density control at a time other than said mode time and yet under a same environmental condition, said mode is released.

6. The image forming apparatus according to claim 5, wherein said electrostatic image forming condition is a value of a potential difference between an image portion and a non-image portion in the electrostatic image.

7. The image forming apparatus according to claim 1, wherein said control means changes forming conditions of said replenishing control electrostatic image and said image density control electrostatic image based on the result of detecting by said environment detecting means.

8. The image forming apparatus according to claim 1, wherein said control means advances to said mode in case the result of detecting by said environment detecting means is changed by more than the predetermined value or in case said replenishment developer is renewed and the result of the detecting by said image density detecting means of the developer which develops the detection electrostatic image formed based on the detection result of said environment detecting means by said developing apparatus is outside of a predetermined scope.

* * * * *

UNITED STATES PATENT AND TRADEMARK OFFICE

CERTIFICATE OF CORRECTION

PATENT NO. : 7,218,870 B2
APPLICATION NO. : 11/076925
DATED : May 15, 2007
INVENTOR(S) : Fumitake Hirobe It is certified that error appears in the above-identified patent and that said Letters Patent is hereby corrected as shown below:

COLUMN 1:
Line 45, “above described” should read --above-described--.
Line 53, “non image” should read --non-image--.
Line 56, “an” should read --a--.

COLUMN 2:
Line 41, “moisture conditioned” should read --moisture-conditioned--.
Line 44, “moisture conditioned” should read --moisture-conditioned--.

COLUMN 3:
Line 15, “the-maximum” should read --the maximum--.

COLUMN 4:
Line 1, “moisture” should read --moisture- --.
Line 2, “non-moisture” should read --non-moisture- --.
Line 32, “non-moisture conditioned” should read --non-moisture-conditioned--.
Line 63, “above described” should read --above-described--.
Line 66, “moisture” should read --moisture- --.

COLUMN 5:
Line 42, “above” should read --above- --.

COLUMN 7:
Line 3, “an” should read --a--.
Line 47, “an” should read --a--.

COLUMN 16:
Line 36, “occurred” should be deleted.

UNITED STATES PATENT AND TRADEMARK OFFICE

CERTIFICATE OF CORRECTION

PATENT NO. : 7,218,870 B2
APPLICATION NO. : 11/076925
DATED : May 15, 2007
INVENTOR(S) : Fumitake Hirobe It is certified that error appears in the above-identified patent and that said Letters Patent is hereby corrected as shown below:

COLUMN 18:

Line 10, "above described" should read --above-described--.
Line 52, "above described" should read --above-described--.

Signed and Sealed this

Twenty-fifth Day of December, 2007

JON W. DUDAS
*Director of the United States Patent and Trademark Office*